US007696109B2

(12) United States Patent
Ouellette et al.

(10) Patent No.: US 7,696,109 B2
(45) Date of Patent: Apr. 13, 2010

(54) LOW-DENSITY CLEANING SUBSTRATE

(75) Inventors: William Ouellette, Pleasanton, CA (US); Nikhil Dani, Pleasanton, CA (US); Richard Suk, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 58 days.

(21) Appl. No.: 11/361,105

(22) Filed: Feb. 24, 2006

(65) Prior Publication Data

US 2007/0202766 A1 Aug. 30, 2007

(51) Int. Cl.
*B23B 27/12* (2006.01)
*D04H 1/56* (2006.01)

(52) U.S. Cl. ..... 442/123; 442/327; 442/400; 442/401; 442/405; 442/406; 428/220

(58) Field of Classification Search ..... 442/123, 442/400, 401, 405, 406
See application file for complete search history.

(56) References Cited

U.S. PATENT DOCUMENTS

| | | | | |
|---|---|---|---|---|
| 4,042,453 | A | 8/1977 | Conway et al. | |
| 5,342,534 | A * | 8/1994 | Skrobala et al. | 15/104.93 |
| 5,650,214 | A | 7/1997 | Anderson et al. | |
| 6,172,276 | B1 | 1/2001 | Hetzler et al. | |
| 6,361,784 | B1 * | 3/2002 | Brennan et al. | 424/402 |
| 2003/0118816 | A1 | 6/2003 | Polanco et al. | |
| 2003/0203162 | A1 | 10/2003 | Fenwick et al. | |
| 2004/0131820 | A1 | 7/2004 | Turner et al. | |
| 2005/0090175 | A1 | 4/2005 | Bergholm et al. | |
| 2005/0120497 | A1 | 6/2005 | Lynde et al. | |

FOREIGN PATENT DOCUMENTS

| | | | | |
|---|---|---|---|---|
| EP | 0664842 | | 8/1995 | |
| EP | 1 074 234 | * | 7/2001 | 13/15 |
| WO | WO0066057 | A1 | 11/2000 | |
| WO | WO2004098869 | A1 | 11/2004 | |

* cited by examiner

*Primary Examiner*—Lynda Salvatore
(74) *Attorney, Agent, or Firm*—Erin Collins; Thomas Feix

(57) ABSTRACT

The present invention is directed to a low-density substrate, which has an optimized pore volume distribution. The optimized pore volume distribution allows the substrate to hold at least 50 percent of its cumulative volume within pores with a radius size of about 110 to 250 microns. The optimized pore volume distribution can also be characterized by having a dry fibrous web that absorbs less than 20 percent of the cumulative volume of the fibrous web at a pore radius of 75 microns. The optimized pore volume distribution of the substrate enables it to controllably release a fluid composition effectively onto a surface. The basis weight of the substrate is about 80 to 20 gsm and the density of the substrate is below 0.1 g/cc. The substrate may be a pre-loaded wipe, which is either moistened by a consumer prior to use or moistened prior to packaging. The composition loaded onto the substrate may contain dry and/or liquid compositions preferably for cleaning hard or soft surfaces.

19 Claims, 6 Drawing Sheets

(Clorox Disinfecting Wipes)

(Lysol Sanitizing Wipe)

(Kirkland Wipe)

(PGI 30 gsm)

(PGI 50 gsm)

(Trilayer Substrate)

LOW-DENSITY CLEANING SUBSTRATE

BACKGROUND OF THE INVENTION

1. Field of the Invention

The present invention relates to a low-density cleaning substrate with a basis weight of less than 80 gsm, which may be expanded in the z-direction to give the consumer the appearance of additional perceived bulk and thickness. The present invention further relates to cleaning substrates that are preferably used as wipes for delivering cleaning, disinfecting and surface protective compositions to both hard and soft surfaces. The cleaning substrate may be a pre-loaded cleaning wipe preferably comprised of non-woven materials, which have an optimized pore volume distribution that allows the pre-loaded cleaning composition to be controllably released from the substrate.

2. Description of Related Art

A variety of liquid and solid or semi-solid ingredients have been deposited onto various forms of substrates for a variety of purposes. Typically, the substrates are wipes, formed of either a woven or non-woven material, and containing a liquid active composition. In one form, a non-woven material is soaked in a liquid cleaning active, and packaged in a canister. One example of this form of a disposable cleaning wipe is a product manufactured and sold by the Clorox Company under the trademark Clorox® Disinfecting Wipes.

Cleaning wipes have long been used for a variety of purposes. Such cleaning wipes have contained various compounds to accomplish their intended purpose. Cleaning wipes have included soaps and detergents to clean hard surfaces such as tiles, ceramics, counter tops, floors, and the like, as well soft surfaces such as fabrics and upholstery. Wipes have been formulated with personal care products, for example to clean an individual's hands. Cleaning wipes have also included ammonia to clean glass surfaces. Alcohol and various other biocides, such as quats, and biguanides have been included on cleaning wipes to disinfect a variety of surfaces. Cleaning wipes have also included waxes to polish and clean furniture.

All of the foregoing examples are limited in at least one or more of the following ways. First, many of the wipes or substrates have a basis weight of 45 to 80 gsm or more because higher basis weight substrates are customarily used because of their ability to effectively absorb and hold cleaning compositions. Secondly, many of the existing wipes are flat and consumers have traditionally rejected flat, low basis weight cleaning wipes and substrates because they appear too flimsy or thin to effectively clean surfaces. Thirdly, many of the existing cleaning substrates are geared toward maximizing absorption capacity and are not designed to controllably release a pre-loaded cleaning composition.

U.S. Pat. No. 4,042,453 to Conway, et al. is directed to a tufted non-woven water-laid fibrous web with high bulk and absorbency. The tufted non-woven webs described by Conway may be produced at basis weights as low as 0.5 ounces per square yard (osy) but most materials are at least 1 osy or higher. This patent discloses a tufting process for non-woven substrates, which increases absorbency and softness and creates the appearance of bulk even at low basis weights. Since this invention is focused on increasing absorption capacity, it is limited to tufted non-woven webs that quickly absorb fluids rather than non-wovens, which slowly and controllably release fluids.

U.S. Pat. No. 5,650,214 to Anderson, et al. describes a soft, elastic-like web material with raised rib texture patterns. This patent refers to a wide variety of methods for forming textured webs including thermoforming, applying high-pressure plates or rolls, hydraulic forming, casting and embossing. This patent teaches webs that are capable of exhibiting "elastic-like" behavior without the need for more expensive traditional elastomeric materials. The patent is limited in that it requires that the web material contain elastomeric materials that enable the web to stretch and deform along at least one axis. Therefore, this patent does not teach or direct use of textured web materials outside the area of elastic-like applications.

U.S. Pat. No. 6,172,276 to Hetzler, et al. describes an absorbent, low-density web material used for personal care products. To maximize absorbency of menses this patent teaches that the web should have a pore size distribution where more than 50 percent of the pore diameters are between 80 and 400 microns, as measured by a receding liquid. This reference teaches that in low-density substrates a high percentage of large pore sizes are beneficial for wicking and absorbency, but uses only receding liquid curves without any mention of the significance of advancing liquid curves or the relative importance between the two curves. Furthermore, the claims are directed to the percentage of pores with diameters between 80 and 400 microns and not the percentage of cumulative volume held in specific pore sizes. This patent is limited to a personal care product for absorbing menses and with more than 50 percent of the pores diameters are between 80 and 400 microns.

U.S. Patent Application Publication No. 2004/0131820 relates to tufted fibrous webs with discontinuous portions defining a longitudinal axis. The patent further describes the fibrous webs as being formed from spunbond or meltblown fibers with basis weights any where in the range of 10 to 500 gsm. The application is limited to webs with asymmetrical deformations having a longitudinal axis that are absorbent or non-absorbent, but not substrates capable of controllably releasing fluids.

United States Patent Application Publication No. 2003/0203162 to Fenwick, et al. describes a process for creating a non-woven fabric using three-dimensional surface features that are air permeable. The non-woven fabric of the invention has a basis weight from 3 to 400 gsm. The non-woven material of the application is primarily directed toward personal care products and is limited because it requires that it be made using a three-dimensional surface with features that are air permeable.

United States Patent Application Publication No. 2003/00118816 to Polanco, et al. describes a high loft, low-density non-woven web with a basis weight of 0.3 to 25 osy. This patent application requires that the non-woven web have spunbond, crimped bicomponent fibers of A/B side-by-side morphology. In addition, the non-woven material of this application is designed for its fast wicking and absorption capacity rather than its ability to controllably release fluids.

PCT Patent Publication No. WO2004/098869 to Pourdeyhimi et al. describes three-dimensional molded non-woven materials that comprise thermoplastic components to make the substrate more rigid and stiff. This reference teaches three-dimensional non-woven materials that have basis weights in the range of 90 to 350 gsm and are designed to act as sturdy compression supports. Therefore this reference does not disclose three-dimensional non-woven substrates with low basis weights.

European Patent Publication No. WO/0066057 to White et al. describes a method of manufacturing non-woven materials having surface features and the materials produced thereby. This publication describes forming non-woven materials into a three-dimensional non-woven web and coating the web with raised ridges. The non-woven materials may have low basis weights of about 0.25 to 50 osy. This publication is limited to absorbent, non-woven webs with continuous fibers having ridges and does not describe or suggest non-woven low basis weight substrates, which are capable of controllably releasing fluids.

European Patent No. 0664842 to Milligan describes a meltblown non-woven web formed with thermoplastic polymer fibers. The meltblown non-woven web has a low packing density and is air permeable because it is generally used for filtration devices. The patent is limited to meltblown non-woven materials with thermoplastic fibers.

In view of the present state of the art of non-woven substrates such as cleaning wipes, there remains a need for a low-density non-woven substrate that may be expanded in the z-direction and has the majority of the cumulative pore volume contained in a specific pore size range so that it is capable of controllably releasing a cleaning composition.

SUMMARY OF THE INVENTION

In one aspect the present invention is directed to a low-density substrate, which has an optimized pore volume distribution. The basis weight of the substrate is about 15 to 80 gsm. The pore volume distribution of the substrate enables it to controllably release a fluid composition effectively onto a surface. The substrate may be a pre-loaded wipe, which is either moistened by a consumer prior to use or moistened prior to packaging. The composition loaded onto the substrate may contain dry and/or liquid compositions preferably for cleaning hard or soft surfaces. The substrate may comprise a cleaning wipe that is dimensioned and configured for, and intended for, direct manual cleaning of the desired surface, as by manually wiping the surface. The wipe can also be dimensioned and configured for use with a cleaning implement or tool, for example a mop, scrubber, etc, which in turn may be manually, semi-manually, or automatically operated.

The fibrous web or substrate may comprise natural fibers, synthetic fibers, continuous fibers, staple fibers, discontinuous fibers, polypropylene, polyethylene, polyester, PET, copolymers of polypropylene, copolymers of polyethylene, copolymers of PET, water soluble polymers (such as pva, pla, etc.), wood pulp, regenerated cellulose, nylon, cotton, bicomponent fibers, continuous fibers, and combinations thereof including blends or layers of one or more of the above fibers. In a preferred embodiment of the invention, the fibrous web or substrate comprises fibers with a denier of about 0.3 to 10.

In one embodiment of the invention, the substrate contains a non-woven material comprising meltblown, spunbond, spunlaid, SMS (spunbond-meltblown-spunbond), coform, airlaid, wetlaid, carded webs, thermal bonded, through-air-bonded, thermoformed, spunlace, hydroentangled, needled, chemically bonded and combinations thereof.

The substrate or wipe may be used to clean hard or soft surfaces. As used herein, the term "hard surface" includes, but is not limited to, bathroom surfaces (tub and tile, fixtures, ceramics), kitchen surfaces, countertops, appliances, flooring, glass, automobiles and the like. "Soft surfaces" include but are not limited to fabrics, leather, carpets, furniture, upholstery and other suitable soft surfaces. The active-carrying article of the present invention can be used in a variety of household, industrial and institutional applications.

In yet another aspect of the present invention, the article comprises two or more of the aspects, versions or embodiments described herein.

DETAILED DESCRIPTION OF SPECIFIC EMBODIMENTS

Figure 1:
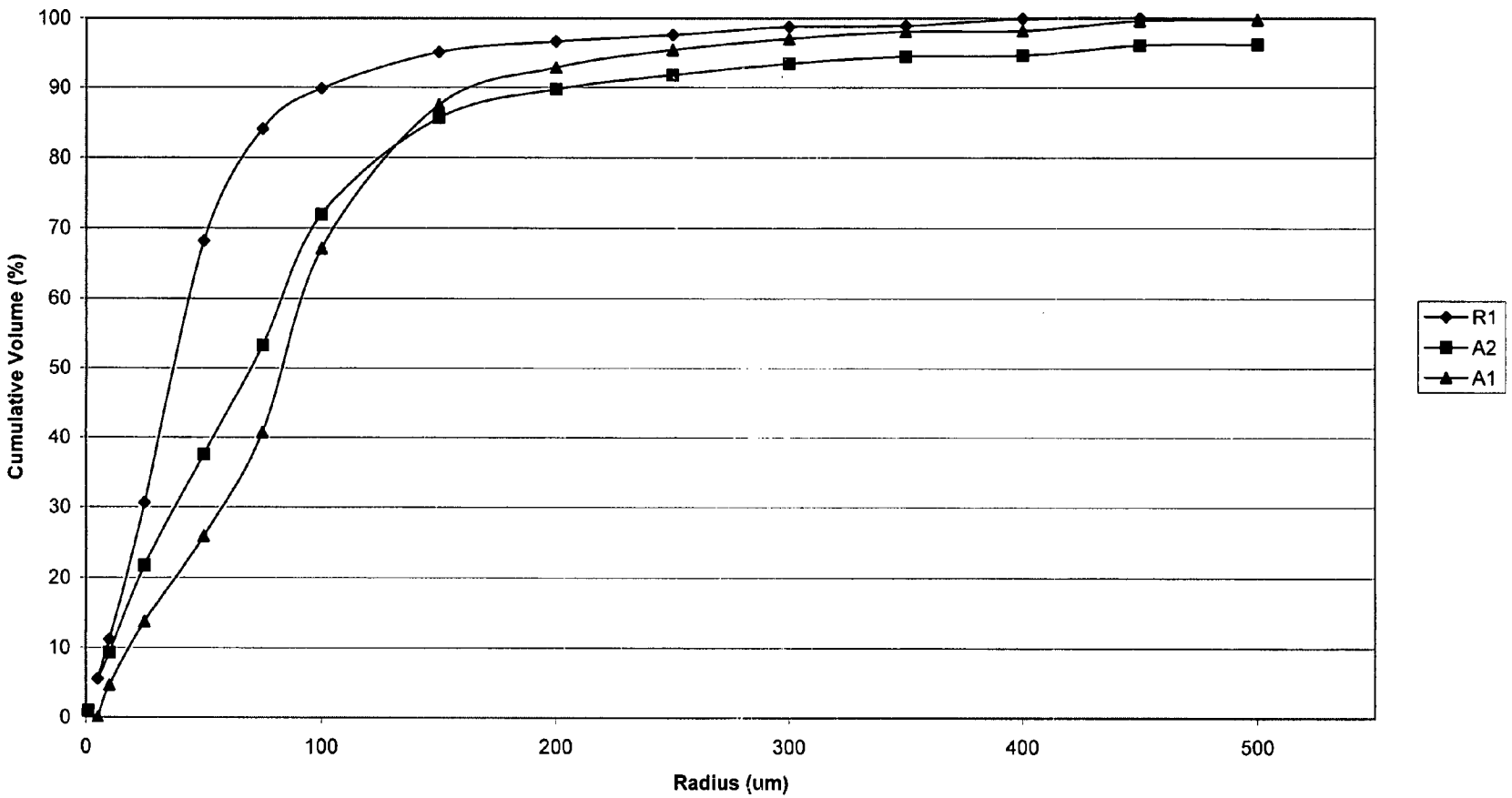
FIGURE 1 PRIOR ART
FIG. 1 is a graph of the pore volume distribution for the prior art sample of a Clorox® Disinfecting Wipe showing the A1, R1 and A2 curves.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

References herein to "one embodiment", "one aspect" or "one version" of the invention include one or more such embodiment, aspect or version, unless the context clearly dictates otherwise.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

As used herein, the terms "substrate" or "wipe" are intended to include any material on which a cleaning composition may be loaded. In functional application, a substrate is used to clean an article or a surface, as by wiping. Substrates comprise woven or non-woven materials, typically made from a plurality of fibers, as well as sponges, films and similar materials onto which cleaning compositions can be loaded as described herein. The substrate can be used by itself (typically by hand) or attached to a cleaning implement, such as a floor mop, handle, or a hand held cleaning tool, such as a toilet cleaning device.

"Cleaning composition" as used herein, is any fluid and/or solid composition used for cleaning hard and/or soft surfaces. Cleaning means any treatment of a surface which serves to remove or reduce unwanted or harmful materials such as soil, dirt or microbial contamination from a surface, and/or which imparts a desirable or beneficial aesthetic, health or safety effect to the surface such as depositing thereon a fragrance, color or protective coating or film.

"Pre-loaded wipes" as used herein, are wipes which are moistened, such as by wetting the wipe with a liquid composition prior to use by the consumer. "Pre-loaded wipes" as used herein, may also refer to wipes that are moistened prior to packaging in a generally moisture impervious container or wrapper. "Pre-loaded wipes" as used herein may even include dry wipes that are impregnated with liquid and dried prior to packaging or solid actives, including but not limited to cleaning agents. Furthermore, "pre-loaded wipes" as referred to herein may in addition, or in the alternative, include wet wipes that have been pre-moistened with liquid compositions, including but not limited to, liquid compositions, such as cleaning agents or lotions.

As used herein, the term "x-y dimension" refers to the plane orthogonal to the thickness of a substrate sheet. The x and y dimensions correspond to the length and width, respectively, of the sheet. In this context, the length of the sheet is the longest dimension of the sheet, and the width the shortest. Of course, the present invention is not limited to the use of cleaning sheets having a rhomboidal shape. Other shapes, such as circular, elliptical, and the like, can also be used.

As used herein, the term "z-dimension" refers to the dimension orthogonal to the length and width of the cleaning sheet of the present invention, or a component thereof. The z-dimension therefore corresponds to the thickness of the cleaning sheet or a sheet component. As used herein, the term "z-dimension expansion" refers to imparting bulk or thickness to a fibrous web by moving fibers out of the x-y dimension and into the z-dimension. A fibrous web with z-dimension expansion can be created by a wide variety of methods, including but not limited to, air texturing, abrasion bulking, embossing, thermoforming, SELFing and any other suitable methods.

As used herein, the term loaded "fiber" refers to a thread-like object or structure from which textiles and non-woven fabrics are commonly made. The term "fiber" is meant to encompass both continuous and discontinuous filaments, and other thread-like structures having a length that is substantially greater than its diameter.

As used herein, the terms "non-woven" or "non-woven web" means a web having a structure of individual fibers or threads which are interlaid, but not in a regular and identifiable manner as in a woven or knitted web. The fiber diameters used in non-wovens are usually expressed in microns, or in the case of staple fibers, denier. Non-woven webs may be formed from many processes, such as, for example, by meltblowing, spunbonding, and bonded carded web processes.

As used herein, the term "basis weight" means the weight per unit area of the substrate or wipe. One method of determining basis weight, therefore, is to weigh a known area sample that is representative of the wipe or substrate. The units of basis weight are typically expressed as grams per square meter (gsm) or ounces of material per square yard. It is noted that to convert from osy to gsm, multiply osy by 33.91.

Non-Woven Materials

The substrate of the present invention can comprise meltblown, spunbond, spunlaid, SMS (spunbond-meltblown-spunbond), coform, airlaid, wetlaid, carded webs, thermal bonded, through-air-bonded, thermoformed, spunlace, hydroentangled, needled, chemically bonded and combinations thereof.

"Meltblown" means fibrous webs formed by extruding a molten thermoplastic material through a plurality of fine, usually circular, die capillaries as molten threads or filaments into converging high velocity heated gas. (e.g., air) streams, which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed for example, in U.S. Pat. No. 3,849,241 to Butin et al. Meltblown fibers are microfibers which may be continuous or discontinuous, are generally smaller than about 0.6 denier, and are generally self bonding when deposited onto a collecting surface. Meltblown fibers used in the present invention are preferably substantially continuous in length.

"Spunbond" refers to fibrous webs comprised of small diameter fibers which are formed by extruding molten thermoplastic material as filaments from a plurality of fine capillaries of a spinneret having a circular or other configuration, with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartmann, U.S. Pat. No. 3,502,538 to Petersen, and U.S. Pat. No. 3,542,615 to Dobo et al., each of which is incorporated herein in its entirety by reference. Spunbond fibers are quenched and generally not tacky when they are deposited onto a collecting surface. Spunbond fibers are generally continuous and often have average deniers larger than about 0.3, more particularly, between about 0.6 and 10.

A multilayer laminate may be an embodiment wherein some of the layers are spunbond and some meltblown such as a spunbond/meltblown/spunbond (SMS) laminate as disclosed in U.S. Pat. No. 4,041,203 to Brock et al. and U.S. Pat. No. 5,169,706 to Collier, et al., each hereby incorporated by reference. The SMS laminate may be made by sequentially depositing onto a moving conveyor belt or forming wire first a spunbond web layer, then a meltblown web layer and last another spunbond layer and then bonding the laminate in a manner described above. Alternatively, the three web layers may be made individually, collected in rolls and combined in a separate bonding step.

"Spunlaid" materials are nonwoven fabrics made by the extrusion of filaments which are then laid down in the form of a web and subsequently bonded. The subsequent bonding of the filaments may be accomplished by a variety of different bonding techniques.

As used herein, the term "through-air bonding" or "TAB" means the process of bonding a nonwoven, for example, a bicomponent fiber web in which air which is sufficiently hot to melt one of the polymers of which the fibers of the web are made is forced through the web. The air velocity is between 100 and 500 feet per minute and the dwell time may be as long as 6 seconds. The melting and re-solidification of the polymer provides the bonding. Through air bonding has relatively restricted variability and since it requires the melting of at least one component to accomplish bonding and is therefore particularly useful in connection with webs with two components like conjugate fibers or those which include an adhesive. In the through-air bonder, air having a temperature above the melting temperature of one component and below the melting temperature of another component is directed from a surrounding hood, through the web, and into a perforated roller supporting the web. Alternatively, the through-air bonder may be a flat arrangement wherein the air is directed vertically downward onto the web. The operating conditions of the two configurations are similar, the primary difference being the geometry of the web during bonding. The hot air melts the lower melting polymer component and thereby forms bonds between the filaments to integrate the web.

"Hydroentangled" or "spunlace" refers to materials created by a method that involves forming either a dry-laid or wet-laid fiber web, where after the fibers are entangled by means of very fine water jets under high pressure. A plurality of rows of water jets is directed towards the fiber web, which is carried on a moving wire. The entangled web is thereafter dried. Those fibers which are used in the material can be synthetic or regenerated staple fibers, e.g. polyester, polyamide, polypropylene, rayon and the like, pulp fibers or a mixture of pulp fibers and staple fibers. Spunlace material can be produced to a high quality at reasonable cost and display high absorption capability. Spunlace materials are frequently used as wiping materials for household or industrial applications and as disposable materials within health care industries, etc.

As used herein, the term "coform" means a process in which at least one meltblown diehead is arranged near a chute through which other materials are added to the base material or the web while it is forming. Such other materials may be pulp, superabsorbent particles, cellulose or staple fibers, for example. Coform processes are shown in U.S. Pat. No. 4,818,464 to Lau.

The term "carded web" refers to non-woven materials formed by the disentanglement, cleaning and intermixing of fibers to produce a continuous web, of generally uniform basis weight, suitable for subsequent processing. This is achieved by passing the fibers between relatively moving surfaces covered with card clothing. The carding processes as are known to those skilled in the art and further described, for example, in U.S. Pat. No. 4,488,928 to Alikhan and Schmidt, which is incorporated herein in its entirety by reference. As used herein, "bonded carded web" refers to webs that are made from staple fibers which are sent through a combing or carding unit, which breaks apart and aligns the staple fibers in the machine direction to form a generally machine direction-oriented fibrous non-woven web. Such fibers are usually purchased in bales which are placed in a picker which separates the fibers prior to the carding unit. Once the web is formed, it then is bonded by one or more of several known bonding methods. One such bonding method is powder bonding, wherein a powdered adhesive is distributed through the web and then activated, usually by heating the web and adhesive with hot air. Another suitable bonding method is pattern bonding, wherein heated calendar rolls or ultrasonic bonding equipment are used to bond the fibers together, usually in a localized bond pattern, though the web can be bonded across its entire surface if so desired. Another suitable and well-known bonding method, particularly when using conjugate staple fibers, is through-air bonding.

The non-wovens used in the process according to the invention may be produced by any of the known processes described above and any combinations of these processes. In addition, any changes or modifications to the process known to one skilled in the art should also be considered to be within the scope of the present invention.

Z-Direction Expansion

In one embodiment of the invention, the substrates undergo processing to expand the fibrous web in the z-direction to increase the bulk and thickness of the web while maintain a low basis weight. The Z-direction expansion of the substrates of the present invention may reduce the density of the web in two dissimilar ways: overall density and localized density. Overall density is calculated by, 1) measuring the overall caliper of the web over a large area (i.e. ~25 $cm^2$), and 2) dividing the basis weight (in grams per $cm^2$) by the caliper (in cm) to yield the density in g/cc. Localized density is determined in a similar manner except that the caliper is the average of the thinnest portion of the web measured perpendicular to the surface of said web portion.

The caliper of a substrate is a measure of its thickness. The overall caliper of a substrate is a measurement of the highest to lowest point on a substrate and the local caliper is a measurement of the thickness of the substrate at a given point. The substrate of the present invention may be flat, where the local caliper is substantially equal to the overall caliper or it may be textured where the local caliper and the overall caliper have substantially different values. In a preferred embodiment of the invention, the fibrous web has a local caliper that is less than about 10% to 75% of the overall caliper. The overall caliper measurement was performed at a pressure of 0.01 psi. Any caliper measurement equipment capable of measuring at this pressure should be suitable for measuring the overall caliper. The SDL Atlas Digital Thickness Gauge, Model #M034A is another effective tool for measuring these calipers. The local caliper is best measured using a microscope without applying any pressure to the substrate.

Various processes can be utilized to achieve Z-direction expansion. One type of process decreases both overall density and local density. A second set of processes decreases the overall density without significantly altering the local density. Processes that belong to the first group include, but are not limited to, bulking via abrasion, air texturing, heat activation to bulk by gathering with blends of fibers and/or bicomponent fibers, or combinations thereof. Processes that belong to the second group move the fibrous web center-line out of the x-y dimension and include, but are not limited to: thermoforming, bicomponent heat shrinking, convoluted forming wires, male-male mated rolls, embossing rolls, "SpaceNet", ring-rolling, SELFing, and/or combinations thereof.

The processes for thermoforming, using forming wires or forming surfaces to create texture in a non-woven is well known in the art. The non-woven materials formed around a textured wire or forming surface using heat to shape the fibers into place. Similarly, embossing or heated male-male mated rolled with interlocking dual pin rolls use heat and/or pressure to create textured non-woven materials and are also widely used in the art.

The term "bicomponent heat shrinking", refers to a process of crimping fibers that may be achieved using combinations of heat shrinkable polymers with non-heat shrinkable polymers. The combination heat shrinkable and non-heat shrinkable polymers may be either sheath-core arrangement or extended side-by-side in a substantially continuous thermoplastic bicomponent filament. The z-direction expansion occurs because as the bicomponent fibers are heated the melting point of one polymer differs from the other polymer causing one polymer while the other polymer retains its normal length thereby creating a crimping effect. Suitable bicomponent fibers include, but are not limited to: polyethylene/polypropylene, polyethylvinyl acetate/polypropylene, polyethylene/polyester, polypropylene/polyester, copolyester/polyester, and the like.

The term "SpaceNet" refers to materials comprising a synthetic thermoplastic fiber network of fibers and have topographical features as illustrated and described in U.S. Pat.

Nos. 5,731,062, 5,851,930 and 6,007,898 and typically have greater than 50 percent open area. Generally, SpaceNet material is a woven network of polyester fibers that is thermoformed into a pattern having topographical features using forming wire, bonding wire and/or forming surface. The SpaceNet materials have an open-mesh structure having filigree like appearance. These materials are formed using and may be purchased from SpaceNet, Inc. of Monroe, N.C.

The terms "ring-rolling" or "pre-corrugating" refer to a process of partial disentanglement of web material fibers which can be accomplished by passing the web through a nip between grooved or patterned rolls. The ring-rolling process has been thoroughly described in U.S. Pat. No. 4,107,364 issued to Sisson on Aug. 15, 1978; U.S. Pat. No. 5,143,679 issued to G. M. Weber et al. on Sep. 1, 1972; U.S. Pat. No. 5,156,793 issued to K. B. Buell et al. on Oct. 20, 1992; and U.S. Pat. No. 5,167,897 issued to G. M. Weber et al. on Dec. 1, 1992; all incorporated herein by reference.

The term "SELFing" is a modified form of a ring a rolling method, which stands for "Structural Elastic-like Film". In the SELFing process the web material is passed through ring rollers with non-continuous ridges or groves so that some portions of the web remain flat or unactivated. SELFing is described in U.S. Pat. No. 5,518,801, entitled "Web Materials Exhibiting Elastic-Like Behavior", issued May 21, 1996 to Chappell et al.; U.S. Pat. No. 5,650,214, issued on Jul. 22, 1997 to Anderson et al.; and U.S. Pat. No. 6,114,263, issued Sep. 5, 2000 to Benson, et al.; U.S. patent application Ser. No. 09/669,329, filed Sep. 25, 2000 by Anderson et al.; all are incorporated herein by reference. Traditionally, the SELFing process creates usable elasticity by reducing the effective modulus of a web or film, allowing the web to stretch and bounce back to its original shape. In a preferred embodiment of the present invention, the substrate may be formed using the SELFed materials to increase the bulk while leaving unactivated or flat zones to maintain web stability.

Types of Fibers

The fibrous web or substrate may comprise natural fibers, synthetic fibers, polypropylene, polyethylene, polyester, PET, wood pulp, regenerated cellulose, nylon, cotton, bicomponent fibers, continuous fibers, and combinations thereof including blends or a layers of one or more of the above fibers. In a preferred embodiment of the invention, the fibrous web or substrate comprises fibers with a denier of about 0.3 to 10.

Suitable thermoplastic fibers can be made from a single polymer (monocomponent fibers), or can be made from more than one polymer (e.g., bicomponent or multicomponent fibers). Multicomponent fibers are described in U.S. Pat. App. 2003/0106568 to Keck and Arnold. Bicomponent fibers are described in U.S. Pat. 6,613,704 to Arnold and Myers and references therein. Multicomponent fibers of a wide range of denier or dtex are described in U.S. Pat. App. 2002/0106478 to Hayase et. al.

As used herein, the term "bicomponent fibers" refers to fibers formed from at least two different polymers extruded from separate extruders but spun together to form one fiber. Bicomponent fibers are also sometimes referred to as conjugate fibers or multicomponent fibers. The polymers are arranged in substantially constantly positioned distinct zones across the cross-section of the bicomponent fibers and extend continuously along the length of the bicomponent fibers. The configuration of such a bicomponent fiber may be, for example, a sheath/core arrangement wherein one polymer is surrounded by another, or may be a side-by-side arrangement, a pie arrangement, or an "islands-in-the-sea" arrangement, each as is known in the art of multicomponent, including bicomponent, fibers.

The "bicomponent fibers" may be thermoplastic fibers that comprise a core fiber made from one polymer that is encased within a thermoplastic sheath made from a different polymer or have a side-by-side arrangement of different thermoplastic fibers. The first polymer often melts at a different, typically lower, temperature than the second polymer. In the sheath/core arrangement, these bicomponent fibers provide thermal bonding due to melting of the sheath polymer, while retaining the desirable strength characteristics of the core polymer. In the side-by-side arrangement, the fibers shrink and crimp creating z-direction expansion.

Bicomponent fibers can be splittable fibers, such fibers being capable of being split lengthwise before or during processing into multiple fibers each having a smaller cross-sectional dimension than the original bicomponent fiber. Splittable fibers have been shown to produce softer nonwoven webs due to their reduced cross-sectional dimensions. Representative splittable fibers useful in the present invention include type T-502 and T-512 16 segment PET/nylon 6 2.5 denier fibers; and type T-522 16 segment PET/PP splittable fibers, all available from Fiber Innovation Technology, Johnson City, Tenn.

Suitable bicomponent fibers for use in the present invention can include sheath/core or side-by-side fibers having the following polymer combinations: polyethylene/polypropylene, polyethylvinyl acetate/polypropylene, polyethylene/polyester, polypropylene/polyester, copolyester/polyester, and the like. Particularly suitable bicomponent thermoplastic fibers for use herein are those having a polypropylene or polyester core, and a lower melting copolyester, polyethylvinyl acetate or polyethylene sheath (e.g., those available from Danakion a/s, Chisso Corp., and CELBOND®, available from Hercules). These bicomponent fibers can be concentric or eccentric. As used herein, the terms "concentric" and "eccentric" refer to whether the sheath has a thickness that is even, or uneven, through the cross-sectional area of the bicomponent fiber. Eccentric bicomponent fibers can be desirable in providing more compressive strength at lower fiber thicknesses.

In a preferred embodiment of the invention, the fibers in the substrate can be comprised of hydrophilic fibers or a combination of both hydrophilic and hydrophobic fibers. The use of hydrophilic fibers for the substrate is desirable because it increases the absorption and retention fluids in the substrate, which is particularly beneficial for increasing the loading capacity of low-density and/or synthetic substrates. Suitable hydrophilic fibers for use in the present invention include cellulosic fibers, modified cellulosic fibers, rayon, cotton, and polyester fibers, such as hydrophilic nylon (HYDROFIL®). Suitable hydrophilic fibers can also be obtained by hydrophilizing hydrophobic fibers, such as surfactant-treated or silica-treated thermoplastic fibers derived from, for example, polyolefins such as polyethylene or polypropylene, polyacrylics, polyamides, polystyrenes, polyurethanes and the like.

The surface of the hydrophobic thermoplastic fiber can be rendered hydrophilic by treatment with a surfactant, such as a nonionic or anionic surfactant, e.g., by spraying the fiber with a surfactant, by dipping the fiber into a surfactant or by including the surfactant as part of the polymer melt in producing the thermoplastic fiber. Upon melting and re-solidification, the surfactant will tend to migrate to the surfaces of the thermoplastic fiber. Suitable surfactants include nonionic surfactants such as Brij® 76 manufactured by ICI Americas, Inc. of Wilmington, Del., and various surfactants sold under the Pegosperse® trademark by Glyco Chemical, Inc. of Greenwich, Conn. In addition to nonionic surfactants, anionic surfactants can also be used to create a hydrophilic treatment. These surfactants can be applied to the thermoplastic fibers at levels of, for example, from about 0.2 to about 1 g per square meter of thermoplastic fiber.

Basis Weight and Density

The fibrous web or substrate of the present invention has a basis weight of about 15 to 80 gsm. Most preferably, the basis weight of the substrate is about 20 to 40 gsm. In comparison to the substrates used as cleaning wipes currently on the market with basis weights of. 45 to 80 gsm (shown in FIGS. 1 to 3), the preferred wipes of the present invention have a substantially lower basis weight. In addition, the density of the substrates of the present invention is less than about 0.12 g/cc. Most preferably the density of the substrates is in the range of about 0.005 to 0.07 g/cc. The lower basis weight and density substrates of the present invention are desirable because they are less costly to produce than the currently available substrates used for cleaning wipes, but they still retain sufficient strength and dispensing capacity to be effective for cleaning.

Pre-Loaded Wipes and Cleaning Tools

The fibrous web or substrate upon which a cleaning composition is loaded comprises a woven or nonwoven fibrous material, in the form of a wipe or pad. The substrate may further comprise a single or unitary layer, or may comprise multiple layers, which may or may not be adhered to one another.

In one embodiment, it is preferred that the substrate is produced in the form of a continuous roll. The substrate may also take the form of a continuous roll, which may be perforated at intervals to define user-generated cut sheets, or may remain in a roll and be marketed as such. The roll of substrate, with or without perforations, may be packaged in a suitable container or overwrap. It is also within the scope of the present invention to produce the substrate as a plurality of individual cut sheets. Thus in yet a further embodiment, the fibrous web is produced as a sheet or web which is cut, die-cut or otherwise sized into the desired appropriate shape and size. The individual sheets making up the substrate may similarly be packaged in a suitable container or overwrap.

In another aspect of the present invention, the cleaning wipe may be individually sealed with a heat-sealable and/or glueable thermoplastic overwrap (such as, but not limited to, polyethylene, Mylar and the like). In one embodiment, the cleaning wipes are packaged as numerous, individual sheets containing the particulate composition of the present invention. In another embodiment, the cleaning wipes are formed as a continuous web during the manufacturing process and loaded into a dispenser, such as a canister with a closure or a tub with closure.

In one embodiment, the active-carrying article may have on one surface an impermeable or backing layer, for example, as a moisture barrier, and/or may include an attachment layer to facilitate attachment of the substrate to a cleaning tool. Impermeable layers may comprise a polymeric film, such as a polyvinyl alcohol/acetate films or the like. An attachment layer may take any form to provide the function of securing the fibrous web network containing active to a correspondingly appropriate cleaning tool, again in virtually any form. An attachment layer may comprise, for example, a high loft fibrous material, or tufted or looped material formatted to attach to a hook material. Suitable tools to which the article herein may be attached comprise floor mops, tub and tile cleaning tools, toilet cleaners, automatic tools, robotic devices and the like.

Test Methods: Pore Volume Distribution

The pore volume distribution curves for the test substrates, shown in FIGS. 1 to 6, were determined with the liquid porosimetry technique (TRI Autoporosimeter) developed at the Textile Research Institute (TRI) in Princeton, N.J., USA. The technique is described more in detail by Miller and Tyomkin in the Journal of Colloid and Interface Science, volume 162 (1994), pages 163-170. The chamber of the Autoporosimeter was equipped with a nitrocellulose-cellulose acetate membrane having a nominal pore diameter of 1.2 μm (Millipore type RAWP, Millipore Corporation, Bedford, Mass., USA). The test solution is 0.01 percent by weight of Triton X-100 surfactant added to deionized water that has an aqueous surface tension of 30 dynes/cm. Triton X-100 is a nonionic surfactant available from the Union Carbide Chemical and Plastics Co. of Danbury Conn., and described generically as octylphenoxy polyethoxy ethanol.

The machine instructions for the TRI Autoporosimeter include starting and continuously leaving on the computer, printer, and monitor and balance. Next, a 0.01% Triton X-100 solution was added into the fluid reservoir with a hexadecane layer covering the test solution to reduce evaporation. Then, the following values were entered as prompted into the computer, 1 g/cm$^3$ for the density, 30 dyne/cm for the surface tension and 1 for cosine θ. Next, the equilibrium balance was set to 10 mg/min and the maximum thickness was set to the measured caliper of the test substrate at 0.05 psi rounded up to the nearest 0.1 mm. Then, the actual height value for the pressure chamber was entered into the program. The number of parallel cycles was set to 1. The interval was set for 10 seconds. The symbol "r" was chosen for radius and the following radii values were used: 5, 10, 25, 50, 75, 100, 150, 200, 250, 300, 350, 400, 450, 500 (um). The chosen radii values were used to produce the Advancing 1, Receding 1 and Advancing 2 curves. Finally, the prompts from the computer program were followed to complete the TRI tests.

To process the data, the ACK51.exe program was run to process the raw data files and obtain a Pore Volume Distribution (PVD) file. Next, the PVD file was opened in Microsoft Excel and the text was converted to columns. To create the pore volume distribution curves, the cumulative volume vs. radii valued were plotted and graphed. Finally, the plots normalized to 100% of total capacity cumulative volume vs. radii to allow for an accurate comparison between the curves by accounting for the fact that different substrates have varying load capacities.

The specific TRI test procedure used to create the cumulative pore volume curves, shown in FIGS. 1 to 6, was performed as follows. First, the porous membrane is positioned in a pressure chamber on a balance accurate to ±0.0001. The membrane is maintained at the same height as a reservoir of test fluid and then pressure is applied to the membrane until all the fluid drains out. Next, a valve is closed to restrict liquid flow to the membrane and the pressure chamber is reopened to put in a 55 mm square test substrate onto the membrane. With the test substrate in the pressure chamber, the chamber is re-pressurized, the valve is opened to begin the test. The pressure is decreased in specific increments until equilibrium is reached at each new pressure level and then the fluid loss or gain on the balance is measured.

The first set of measurements is obtained by incrementally reducing pressure until atmospheric pressure is reached. This first pressure reduction pass is called "Advancing 1 or A1"

because these are measurements of the fluid absorbing or advancing into the test substrate. The second set of measurements is created by incrementally increasing the pressure until it is back to its maximum level. This second set of pressure increasing measurements is called "Receding 1 or R1" because these are measurements of fluid receding or leaving the test substrate. Finally, the third set of measurements is obtained by once again incrementally reducing pressure until atmospheric pressure is reached. This third set of measurements is called "Advancing 2 or A2" because these are measurements of fluid absorbing or advancing into the test substrate for a second time.

Fluid is mostly absorbed and retained in non-woven materials in the capillaries that are formed between the fibers in the non-wovens. The ability of a porous material, such as a non-woven, to absorb and retain liquid can be characterized by the capillary pressure of liquid in the pores of the material. The capillary pressure is defined by the LaPlace equation that is well known in the art: $P=(2\gamma \cos \theta)/r$. In the LaPlace equation, P is the capillary pressure, $\gamma$ is the surface tension of the wetting liquid, $\theta$ is the contact angle between the liquid and the capillary wall, and r is the effective pore radius of the capillary. The surface tension ($\gamma$) of the Triton solution is 30 dynes/cm. By imputing values for $\gamma$ and $\cos \theta$ into the LaPlace equation, the effective pore radius (r) can be calculated from the applied capillary pressure (P).

The measured "cumulative volume" (CV) is the sum of the fluid in the reservoir on the balance in the substrate sample. The total cumulative volume of fluid absorbed varies by substrate from about 6:1 to about 12:1 grams of fluid per grams of substrate. Most of the substrates have a loading capacity in the range of about 10 to 12 grams of fluid per gram of substrate.

Test Methods: Equilibrium Capacity

A solution of Triton x-100 solution, same as used for the PVD test, was prepared using 0.01% Triton and de-ionized water. Samples of each substrate sample material were measured and cut into 8"×7" segments with the 8" dimension in the machine direction (MD). Each substrate sample was then weighed and the weight was recorded as dry weight (DW). Next each substrate sample was placed into the Triton x-100 solution and left for 1 minute. The sample was then removed from the solution and hung to dry with the MD of the sample in the vertical direction for 1 minute. Then the sample was weighed and record as wet weight (WW). EC is expressed in units of grams/gram. This is also commonly referred to as the X-load. The following equation was used to determine the equilibrium capacity (EC) of each sample. $EC=(WW-DW)/DW$.

Test Methods: Preloaded Wipe Preparation Process

Prior to conducting Pore Volume Distribution (PVD) or Equilibrium Capacity (EC) tests on the commercial wipes, Clorox Disinfecting Wipe, Lysol Wipe, and Kirkland Wipe, it was necessary to remove the cleaning lotion that has been loaded onto each of the wipes. The following process for removing the cleaning lotion from commercial wipes was used. The commercial wipe was first soaked in a sufficient amount of isopropyl alcohol to completely cover the wipe. Next, the wipe was then gently agitated in the IPA, so as not to disrupt the pore structure of the web, for at least one minute. Then the wipe was removed from the IPA bath and placed into a vessel with a new solution IPA for one minute. After both baths were complete, the wipe was hung and left to drain for about 5 minutes, until most of the IPA is gone. Then the complete two-bath process is repeated using de-ionized water instead of IPA. When the de-ionized baths are completed, the wipe was moved to a drying rack and allowed to completely dry. The drying process was under normal conditions, with adequate airflow, for approximately 12 to 24 hours. The dried commercial wipes were then used for EC and PVD testing.

Test Methods: Fluid Retention

A final set of tests to measure fluid retention was performed on the PG1 30 gsm material, test substrate 4, and the Clorox Disinfecting Wipe, test substrate 1. Using a cylindrical apertured plunger in a cylindrical container. The PGI 30 gsm wipe was loaded to EC with Triton x-100 solution and then squeezed dry between an appertured plate and a plunger. The PGI 30 gsm wipe retained 26% of the loaded fluid and released 74%. The same method was used on the Clorox Disinfecting Wipe and it retained 40% of the loaded fluid and released 60%. The same test was repeated on each substrate but the second time a blotter was used on the appertured plate to prevent fluid from being trapped in between the plate and substrate. In the second test, the PGI 30 gsm wipe retained only 5% of the loaded fluid and released 95%. The same method was used on the Clorox Disinfecting Wipe and it retained 20% of the loaded fluid and released 80%. In both retention tests, the PGI 30 gsm substrate showed that it is capable of releasing about 10-15% more fluid than the Clorox Disinfecting Wipe. The ability of a substrate to release more of the loaded fluid is a benefit because then less cleaning fluid can be used on the substrate to obtain the same cleaning benefit because a greater percentage of the loaded fluid is reaching the surface being cleaned.

Experimental

| Test Substrate | Percent CV in A1 at r = 75 um | Radius at 50% CV for A1 | Equilibrium Capacity (g/g) | Hysteresis (A1-R1 at 50% CV) |
|---|---|---|---|---|
| 1) Clorox Disinfecting Wipe | 40 | 80 | 5.9 | 60 |
| 2) Lysol Wipe | 42 | 90 | 5.8 | 50 |
| 3) Kirkland Wipe | 20 | 105 | 8.6 | 65 |
| 4) PGI—30 gsm | 2 | 190 | 5.2 | 160 |
| 5) PGI—50 gsm | 1 | 225 | 4.7 | 200 |
| 6) Trilayer Substrate | 10 | 150 | 5.8 | 95 |
| 7) Reemay—34 gsm* | 2 | 225 | 2.2 | 125 |
| 8) BBA—44 gsm* | 5 | 170 | 3.9 | 205 |

*indicates non-inventive test substrates.

In all the Figures, a line with triangle data points depicts Advancing 1 (A1) curve. The Receding 1 (R1) curve is depicted by a line with diamond shaped data points. The Advancing 2 (A2) curve is depicted by a line with square shaped data points.

FIG. 1 shows the pore volume distribution of a prior art substrate sample sold commercially by the Clorox Company under the trademark Clorox® Disinfecting Wipes. The substrate sample depicted in FIG. 1 is made of a flat spunbond non-woven material comprised of both polymer and cellulose fibers produced by Alhstrom Corporation. As indicated in the table above and shown in FIG. 1, in the Advancing 1 (A1) curve is created by incrementally decreasing the pressure on the substrate to increase fluid absorption. In the A1 curve for FIG. 1, the substrate absorbed 40 percent of its total cumulative volume at a pore size of 75 um. In addition, the radius at 50 percent cumulative volume for A1 is 85. These two data points show that pores with a radius of 85 um and below will contain the majority of the cumulative volume initially absorbed onto the substrate. The substrate in FIG. 1 depends largely upon the absorption of fluid by smaller sized pores with a radius of 85 um and below.

Figure 2:
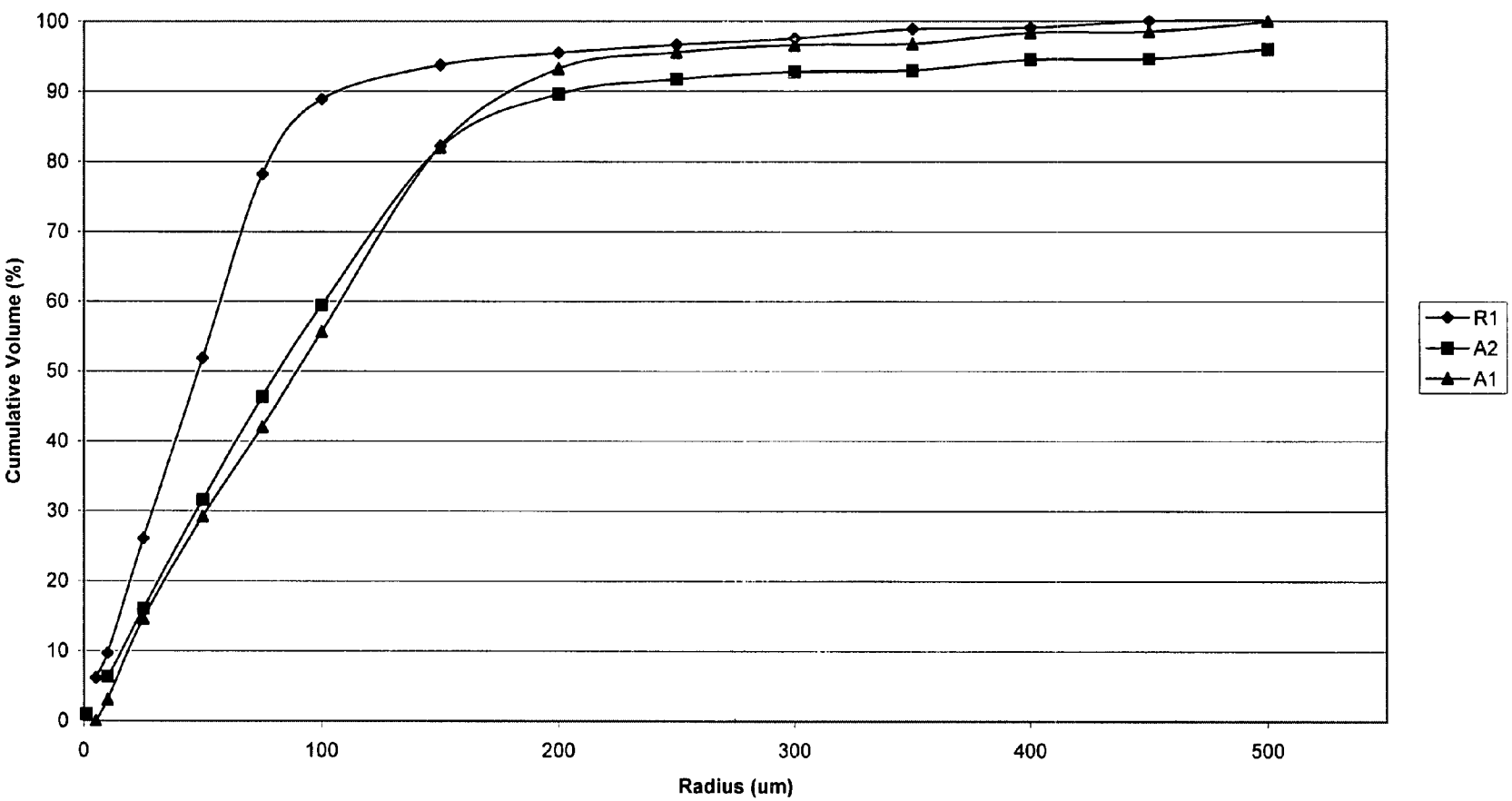
FIGURE 2 PRIOR ART
FIG. 2 is a graph of the pore volume distribution for the prior art sample of a Lysol® Sanitizing Wipe showing the A1, R1 and A2 curves.

FIG. 2 shows the pore volume distribution of a prior art non-woven substrate sample comprised of both polymer and cellulose fibers and sold commercially by the Reckitt & Coleman under the trademark Lysol® Sanitizing Wipes. In the A1 curve for FIG. 2, the substrate absorbed 42 percent of its total cumulative volume at a pore size of 75 um. Similar to the data in FIG. 1, this shows that pores with a radius of 75 um will contain at least 42 percent of the cumulative volume and below which means that a substantial portion of the total cumulative volume is held within relatively small sized pores. In addition, the pore radius at 50 percent cumulative volume for A1 confirms that small pores sized 90 urn and below hold the majority of the fluid on the substrate.

Figure 3:
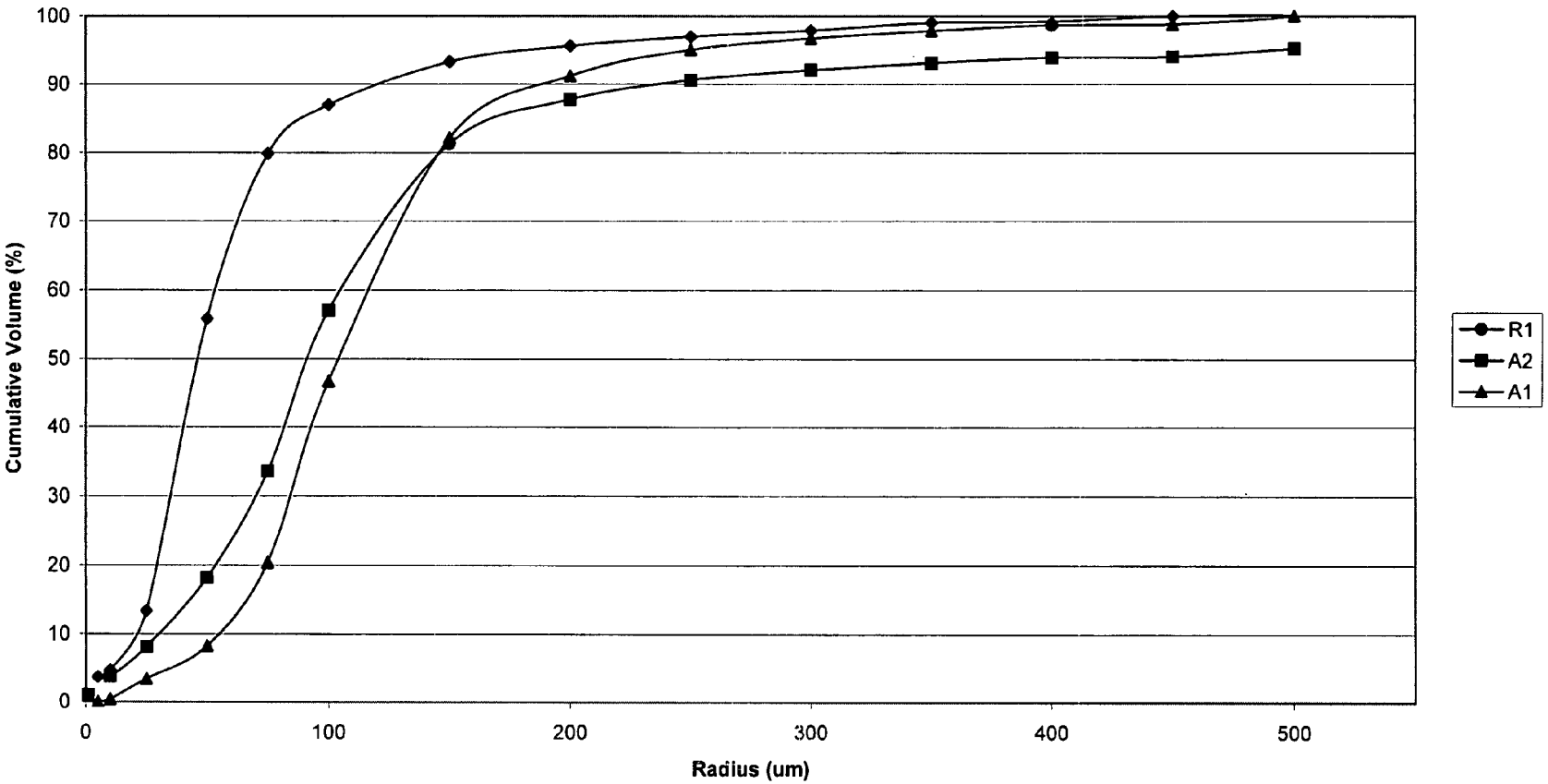
FIGURE 3 PRIOR ART
FIG. 3 is a graph of the pore volume distribution for the prior art sample of a Kirkland® Wipe showing the A1, R1 and A2 curves.

FIG. 3 shows the pore volume distribution of a prior art substrate comprised of a combination of polymeric and cellulosic fibers and sold commercially by the Costco under the trademark Kirland® Wipes. In the A1 curve for FIG. 3, the substrate absorbed 20 percent of its total cumulative volume at a pore size of 75 um. While 20 percent is not as high as the 40 and 42 percent shown in FIGS. 1 and 2, it is still a significant portion of the cumulative volume. Additionally, the pore radius at 50 of cumulative volume for A1 is 105 um. Similar to FIGS. 1 and 2, the Kirkland substrate shows that the majority of the total cumulative volume contained on the substrate is held within relatively small sized pores with a radius of 105 um or less.

FIGS. 1 to 3 each show that 20 percent or more of the cumulative volume initially absorbed into the substrate is contained in pores with a radius of 75 um or less. Additionally, the majority of the cumulative volume initially absorbed into each of the substrates in FIGS. 1 to 3 is contained with pores with a radius of 105 um or less. These two facts show that the smaller sized pores are integral the absorption and retention of fluid within the prior art substrates.

Figure 4:
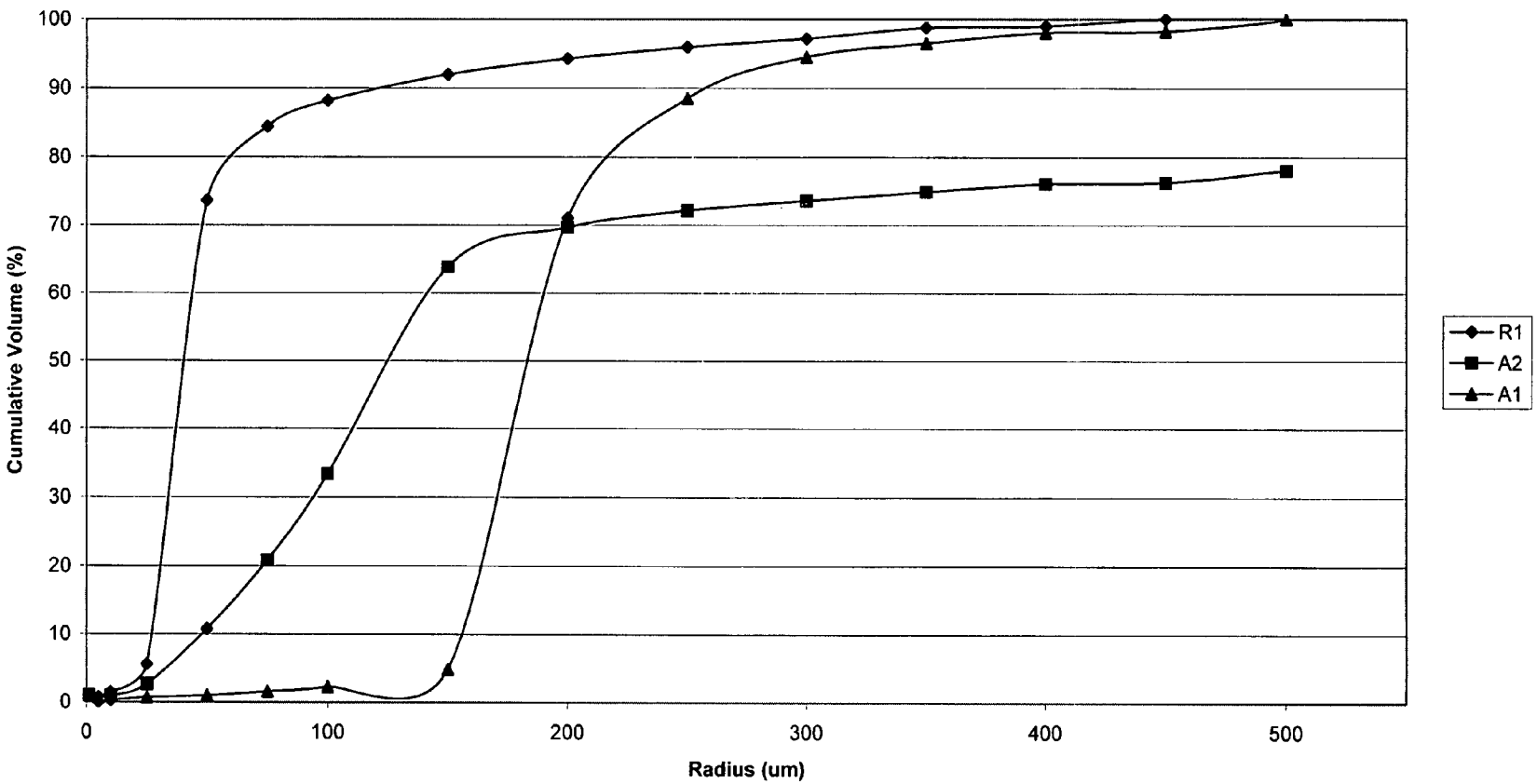
FIG. 4 is a graph of the pore volume distribution for a substrate of the present invention, manufactured by PGI under the code M40206 which is 30 gsm spunbond material, showing the A1, R1 and A2 curves.
Figure 5:
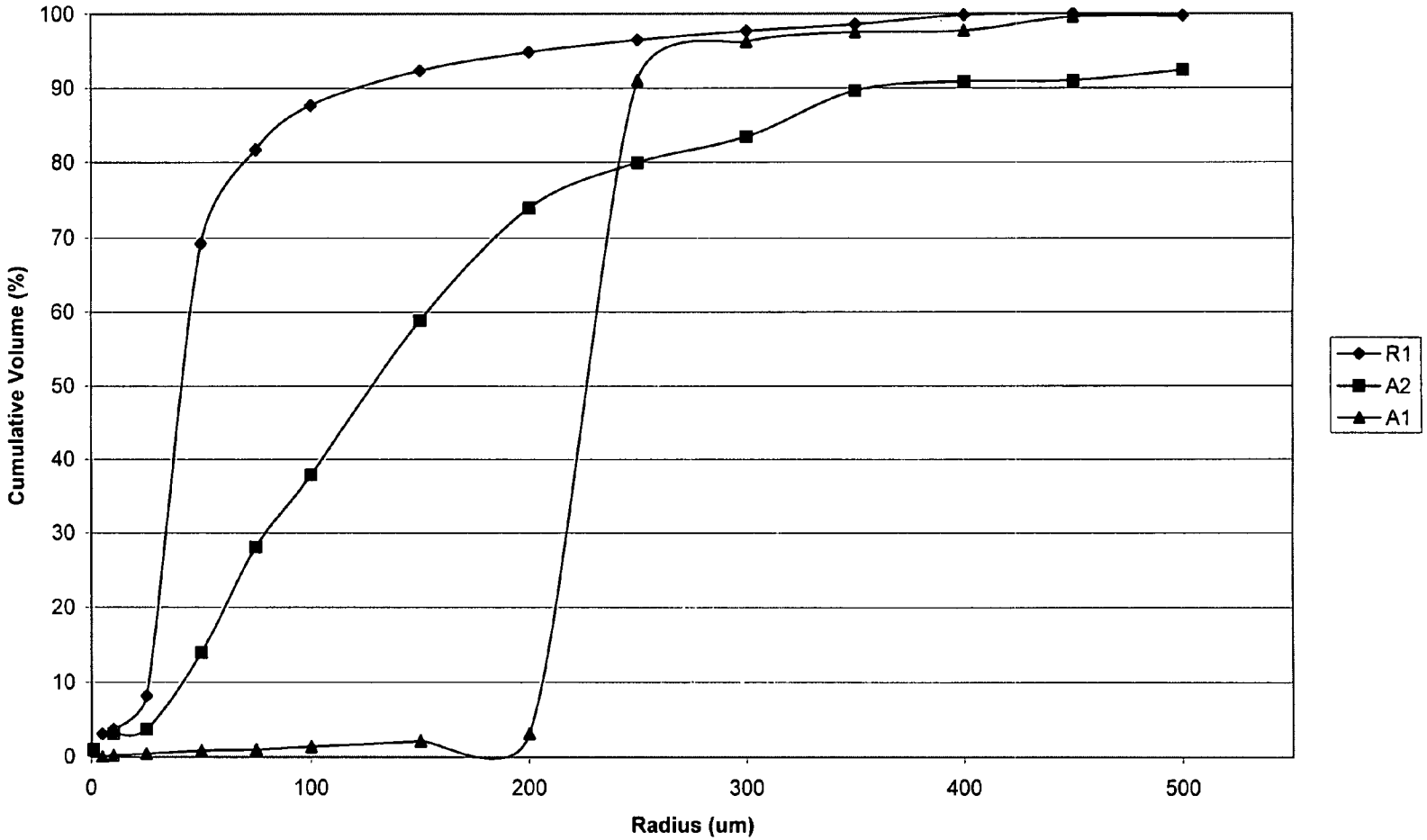
FIG. 5 is a graph of the pore volume distribution for a substrate of the present invention, manufactured by PGI which is 50 gsm spunbond material, showing the A1, R1 and A2 curves.
Figure 6:
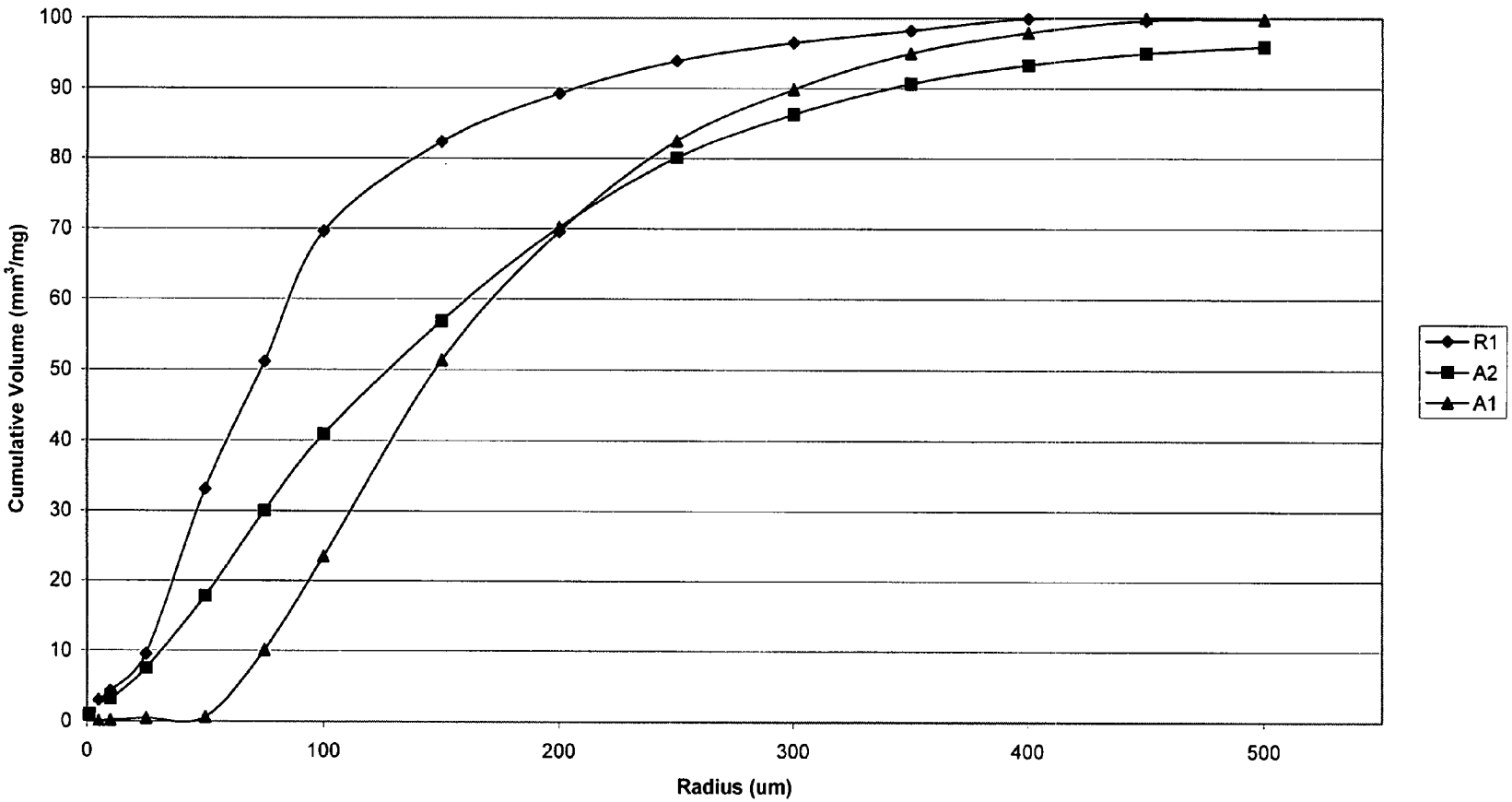
FIG. 6 is a graph of the pore volume distribution for a substrate of the present invention, trilayer laminate of 15 gsm spunbond materials on either side of a single ply tissue with all three layers embossed together, showing the A1, R1 and A2 curves.

FIGS. 4 to 6 show substrates according to the present invention. FIG. 4 shows the pore volume distribution for a hydrophilic, spunbond from Polymer Group, Inc. (PGI) with a basis weight of 30 gsm, made under the code M40206. FIG. 5 shows the pore volume distribution for a hydrophilic spunbond from Polymer Group, Inc. (PGI) with a basis weight of 50 gsm. FIG. 6 is laminate of about 15 gsm spunbond materials on either side of a single ply tissue with all three layers embossed together.

The first critical common feature that each of theses substrate share is dry substrates absorb less than 20 percent of the cumulative volume at a pore radius of 75 microns. In FIGS. 4 and 5, the PGI spunbond substrates of 30 and 50 gsm respectively absorb only 2 and 1 percent of CV for A1 at a pore radius of 75 um. Similarly, the trilayer substrate, shown in FIG. 6, absorbs only 10 percent of CV for A1 at a pore radius of 75 um. In contrast to the prior art, these absorption data points for A1 show that the large majority of the cumulative volume is not held in pores with a radius of less than 75 um. Therefore, all of the inventive substrates absorb less than 20 percent of the A1 cumulative volume of the fibrous web at a pore radius of 75 microns. Similarly, the range of radius sizes at 50 percent CV for A1, for the substrates of FIGS. 4 to 6, is from about 150 to 225 um. These values are roughly double the values of the pore radius sizes at 50 percent CV for A1 of the prior art substrates. For the substrates shown in FIGS. 4 to 6, at least 50 percent of the pore volume is contained within pores with a radius size of about 110 to 250 microns. Therefore, the large majority of the cumulative volume for the substrates of the present invention is held in substantially larger sized pores than that of the prior art substrates.

Another key distinction between the substrates of the present invention and the prior art is that all three prior art figures have relatively lower hysteresis values in comparison to the substrates of the present invention. Hysteresis is measured by the distance between A1 and R1 at 50 percent CV. For the purposes of measuring hysteresis, the 50 percent CV point is half of the average of the A1 max CV and the A2 max CV. The hysteresis values for the prior art substrates from 50 to 65 indicate that the pores are more likely to retain the fluid than substrates with higher hysteresis values, like those of the present invention. Higher hysteresis values indicate that the substrates of the present invention are able to more controllably release fluids when a consumer using the substrate applies pressure to the substrate. Having a substrate that controllably releases a pre-loaded fluid is desirable because the cleaning power of substrate lasts longer if it is able to controllably release fluid. Similarly, a substrate with a controlled release of fluid is cost effective because does not have to be pre-loaded with as much fluid to last the same amount of time as a substrate, which holds onto and does not easily release its pre-loaded fluid. The substrates of the present invention generally hold most of the pre-loaded fluid in larger pores than those of the prior art substrates while still maintaining sufficient absorbency. The absorbency of the wipe is measured as Equilibrium Capacity (EC) and substrates of the present invention have an EC of greater than 4 g/g. The larger pores of the low-density substrates of the present invention are more easily disrupted or modified under the pressure that they would normally experience in use than those of the prior art substrates. This disruption, via applied pressure, of the pore size and shape during use effectively dispenses the liquid. By modifying the applied pressure, the user can control the rate of liquid released from the substrate.

Test substrates 7 and 8, Reemay 34 gsm, under BBA code number 2014, and BBA 44 gsm respectively, are non-inventive test substrates. The Reemay substrate is a spunbond PET material, which is bonded together by flat calendar rolls. The BBA 44 gsm material is a spunbond polypropylene material that is held together by thermal dot bonding points. Test substrates 7 and 8 were tested to demonstrate that substrates, which are formed in a similar manner to the inventive substrates, do not inherently have the same PVD and EC values as that of the inventive substrates. Specifically, both test substrates 7 and 8 absorbs less than 20 percent of the A1 cumulative volume of the fibrous web at a pore radius of 75 microns but neither one of the substrates 7 or 8 have a EC of greater than 4 g/g. Since neither of the substrates 7 or 8 have an EC of greater than 4 g/g they are not suitable for use as a cleaning wipe because they do not absorb enough fluid to be effective as a cleaning wipe.

Although only a few exemplary embodiments of this invention have been described in detail above, those skilled in the art will readily appreciate that many modifications are possible without materially departing from the novel teachings and advantages of this invention. Accordingly, all such modifications are intended to be included within the scope of this invention as defined in the following claims.

The invention claimed is:

1. A pre-loaded cleaning wipe consisting of:

a) a fibrous web for cleaning hard or soft surfaces wherein the fibrous web has a uniform pore volume distribution and consists of one layer of a non-woven material comprising pores having a radius of about 75 to about 250 microns; and b) a cleaning composition loaded onto said fibrous web;

wherein said fibrous web has a total cumulative volume of about 6:1 to about 12:1 grams of said cleaning composition per grams of fibrous web and with a equilibrium capacity of greater than 4 g/g and wherein the fibrous web absorbs less than 20 percent of an A1 cumulative volume of the fibrous web at said pore radius of 75 microns.

2. The wipe of claim 1 wherein the one layer of non-woven material comprises: polypropylene, polyethylene, polyester, PET or combinations thereof.

3. The wipe of claim 2 wherein the non-woven material is selected from the group consisting of: spunbond, meltblown, SMS, carded, wetlaid, airlaid, thermalbonded, hydroentangled, through-air bonded, needled, chemical bonded, and combinations thereof.

4. The wipe of claim 1 wherein the fibrous web comprises a blend of natural and synthetic fibers selected from the group consisting of: polypropylene, polyethylene, polyester, PET, wood pulp, regenerated cellulose, nylon, cotton, bicomponent fibers having a sheath/core arrangement, continuous fibers, and combinations thereof.

5. The wipe of claim 1 wherein the fibrous web has a fluid retention level of less than about 26%.

6. The wipe of claim 1 wherein the fibrous web has a local caliper that is less than about 10% to 75% of an overall caliper.

7. The wipe of claim 1 wherein the fibrous web has an overall density of about 0.005 to 0.07 g/cc.

8. The wipe of claim 1 wherein the web has a basis weight of about 15 to 80 gsm.

9. The wipe of claim 1 wherein the fibrous web is textured, patterned or embossed.

10. The wipe of claim 1 wherein the fibrous web comprises fibers with a denier of about 0.3 to 10.

11. A pre-loaded cleaning wipe comprising: a fibrous web consisting of: one single layer of material with a pore volume distribution in the x-y dimension which comprises pores having a radius of about 110 to about 250 microns and with an overall basis weight less than about 50 gsm and comprising a blend of natural and synthetic fibers throughout the fibrous web and wherein at least 50 percent of an A1 cumulative volume from a cleaning composition loaded onto said fibrous web is contained within pores with a radius size of about 110 to 250 microns.

12. The wipe of claim 11 wherein the fibrous web consists of one layer of non-woven material.

13. The wipe of claim 12 wherein the non-woven material is selected from the group consisting of: spunbond, meltblown, SMS, carded, wetlaid, airlaid, thermalbonded, hydroentangled, through-air bonded, needled, chemical bonded, and combinations thereof.

14. The wipe of claim 11 wherein the fibrous web comprises fibers selected from the group consisting of: natural fibers, synthetic fibers, polypropylene, polyethylene, polyester, PET, wood pulp, regenerated cellulose, nylon, cotton, bicomponent fibers, continuous fibers, and combinations thereof including blends of one or more of the above fibers.

15. The wipe of claim 11 wherein the fibrous web has an overall caliper that is substantially the same a local caliper.

16. The wipe of claim 11 wherein the fibrous web has a local caliper that is less than about 10% to 75% of an overall caliper.

17. The wipe of claim 11 wherein the fibrous web has an overall density of about 0.005 to 0.07 g/cc.

18. The wipe of claim 11 wherein the fibrous web comprises hydrophilic fibers.

19. The wipe of claim 11 wherein the fibrous web comprises fibers with a denier of about 0.3 to 10.

* * * * *